US005274303A

United States Patent [19]

Bakker et al.

[11] Patent Number: 5,274,303

[45] Date of Patent: Dec. 28, 1993

[54] CATHODE RAY TUBE COMPRISING A DISPLAY WINDOW

[75] Inventors: Gijsbertus Bakker, Kaindorf, Austria; Paul Daamen; Frank Gersmann, both of Eindhoven, Netherlands

[73] Assignee: U.S. Philips Corporation, New York, N.Y.

[21] Appl. No.: 890,736

[22] Filed: May 28, 1992

[30] Foreign Application Priority Data

May 29, 1991 [EP] European Pat. Off. ..... 91201277
Feb. 10, 1992 [EP] European Pat. Off. ..... 92200351

[51] Int. Cl.[5] ..... H01J 29/10; H01J 29/86
[52] U.S. Cl. ..... 313/477 R; 220/2.1 A
[58] Field of Search ..... 313/477 R; 220/2.1 A

[56] References Cited

U.S. PATENT DOCUMENTS 4,985,658 1/1991 Ganevazzi ..... 313/477 R

FOREIGN PATENT DOCUMENTS 0448401 9/1991 European Pat. Off. .

*Primary Examiner*—Sandra L. O'Shea
*Attorney, Agent, or Firm*—Paul R. Miller

[57] ABSTRACT

A cathode ray tube comprising a curved substantially rectangular display window, the outside surface and/or inside surface of the display window being given by:

$$z=f(X, Y)$$

where each point situated off the x-axis and the y-axis complies with the formula $$-\sqrt{(z_{xx}z_{yy})}<z_{xy}/\mathrm{sign}XY<0.$$

where
$z_{xx}=\partial^2 z/\partial X^2$,
$z_{yy}=\partial^2 z/\partial Y^2$ and
$z_{xy}=\partial^2 z/(\partial X \partial Y)$
$\mathrm{sign}XY=+1$ for $X*Y>0$, and
$\mathrm{sign}XY=-1$ for $X*Y<0$.

An improved reflection image of linear light sources is obtained.

11 Claims, 3 Drawing Sheets

CATHODE RAY TUBE COMPRISING A DISPLAY WINDOW

Figure 1:
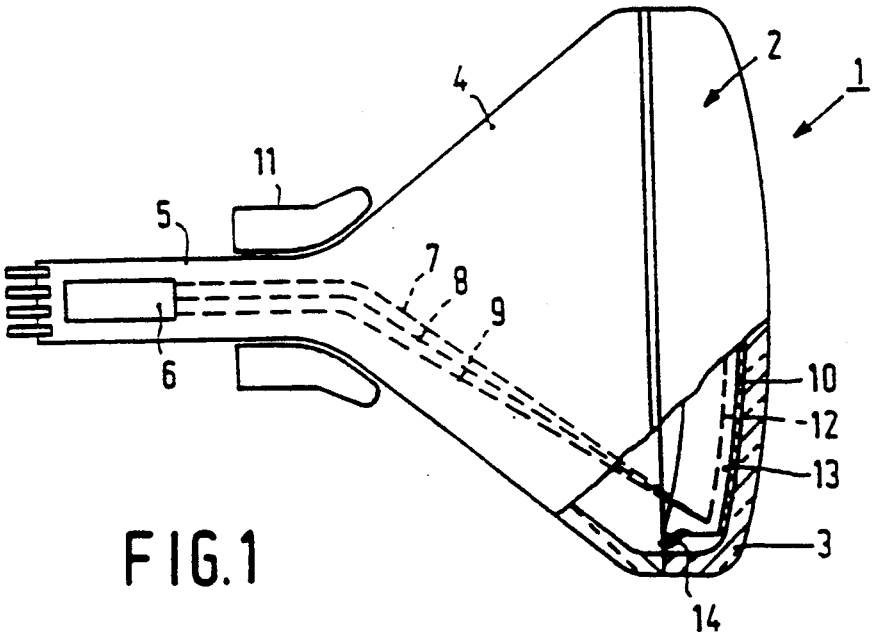

The invention relates to a cathode ray tube comprising a display window having a curved substantially rectangular outside surface with a long axis and a short axis.

BACKGROUND OF THE INVENTION

Cathode ray tubes are used in, inter alia, television receivers, computer monitors and DGD (Data Graphics Display) devices.

In recent years the aim has been to provide display windows having a relatively small curvature. Within the framework of the invention it has been found, however, that disturbing reflections of light sources frequently occur at the outside surface of the display window, so that the perception of flatness of the display window is substantially lost. It is an object of the invention to provide a cathode ray tube in which this disturbing effect has been reduced substantially.

SUMMARY OF THE INVENTION

To this end, a cathode ray tube of the type mentioned in the opening paragraph is characterized according to the invention in that the outside surface of the display window is given by:

$$z=f(X,Y)$$

where X is the x-coordinate divided by half the length of the long axis, Y is the y-coordinate divided by half the length of the short axis, and each point situated off the long axis or short axis complies with the formula:

$$-\sqrt{(z_{xx}z_{yy})}<z_{xy}/\mathrm{sign}XY<0$$

where $z_{xx}=\partial^2z/\partial X^2$, $z_{yy}=\partial^2z/\partial Y^2$, $z_{xy}=\partial^2z/(\partial X\partial Y)$ and $\mathrm{sign}XY=+1$ for $X>0$, $Y>0$ and for $X<0$, $Y<0$ and $\mathrm{sign}XY==-1$ for $X>0$, $Y<0$ and for $X<0$, $Y>0$.

If the above conditions are satisfied, cathode ray tubes having substantially flat display windows, i.e. having display windows with a relatively small average curvature, are perceived as being substantially flat. As has been noted within the framework of the invention, there are conditions in which conventional cathode ray tubes exhibit a disturbing distortion of reflections of light sources. Devices in which cathode ray tubes are used are often arranged in rooms which are artificially lit by elongated horizontally arranged light sources which extend parallel to the display window. Examples of such light sources are fluorescent lamps. The most important source of disturbing reflections in such rooms are such elongated light sources. The disturbing effect which reflections of such light sources have on conventional display windows is somewhat comparable to a distorting-mirror effect, and it gives the impression that the display window is very convex even if the average curvature of the display window is very small. A further effect which may occur in the image displayed is that as a result of such reflections a straight line situated right next to a curved reflection image appears to be curved. A viewer perceives this effect as a decrease in picture quality. The invention provides a cathode ray tube in which these adverse effects are reduced. In the case of a cathode ray tube according to the invention, the reflection image of an elongated horizontal light source has a maximum for the y-value on the short axis, the reflection image of a vertical elongated light source has a minimum for the x-value on the long axis. A "distorting-mirror" effect does not occur. Two reflection images of one point of a light source are never formed on the display window. By virtue thereof, the display window is perceived as being flat and reflections of the light sources are disturbing to a minor degree only. For reasons of simplicity, the conditions stated in the formula above will hereinafter also be referred to as "formula 1".

In a further embodiment of the invention, each line parallel to the long axis complies with the equation: $\partial z/\partial Y=A_1$, $A_2$ and $A_3$, for $X=0$, 1 and 0.5, respectively, where $(A_1-A_3)/(A_1-A_2)<0.1$.

For a line extending parallel to the x axis, the Y-coordinate is a constant. In the above condition, $A_1$, $A_2$ and $A_3$ are shortened forms of $(\partial z/\partial Y)_{x=0}$ etc. If the above condition regarding $\partial z/\partial Y$ is satisfied, relatively little distortion takes place in the reflection of a horizontally arranged linear light source. In the most important part of the display window no or only very little curvature of the reflection images takes place. For the sake of simplicity, these conditions will hereinafter also be referred to as "formula 2".

In a further embodiment of the invention, each line extending parallel to the short axis complies with the equation:

$$\partial z/\partial X=B_1,\ B_2 \text{ and } B_3, \text{ for } Y=0,\ 1 \text{ and } 0.5, \text{ respectively, where } (B_1-B_3)/(B_1-B_2)<0.1$$

$B_1$, $B_2$ and $B_3$ are shortened forms of $(\partial z/\partial X)_y$ etc. If this condition regarding $\partial z/\partial X$ is satisfied, relatively little distortion takes place in the reflection of a vertically arranged linear light source. Such conditions will hereinafter also be referred to as "formula 3".

BRIEF DESCRIPTION OF THE DRAWING FIGURES

Figure 2:
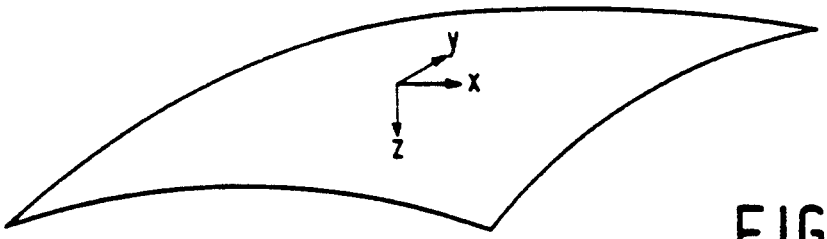
Figure 3A:
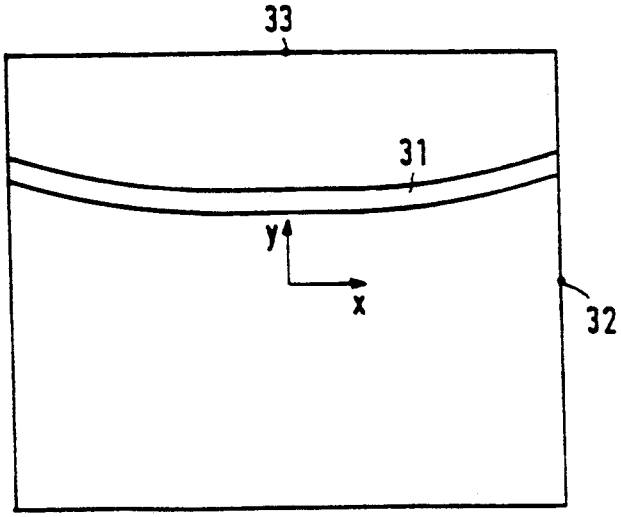
Figure 3B:
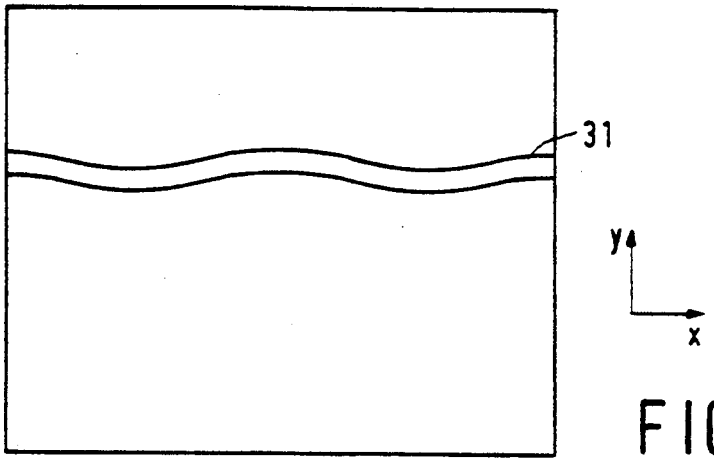
Figure 3C:
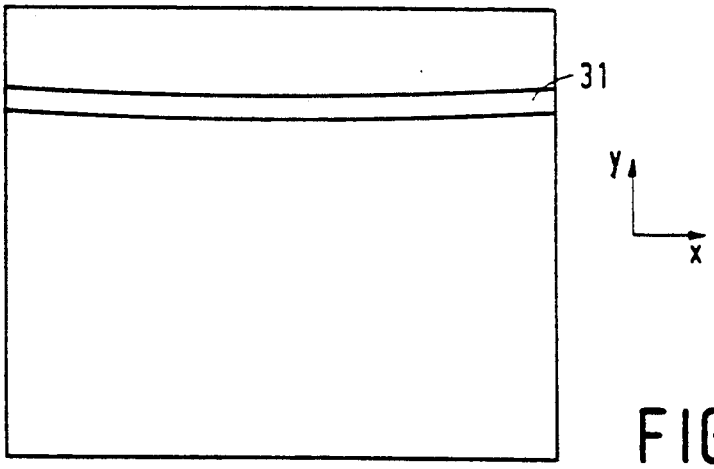
Figure 3D:
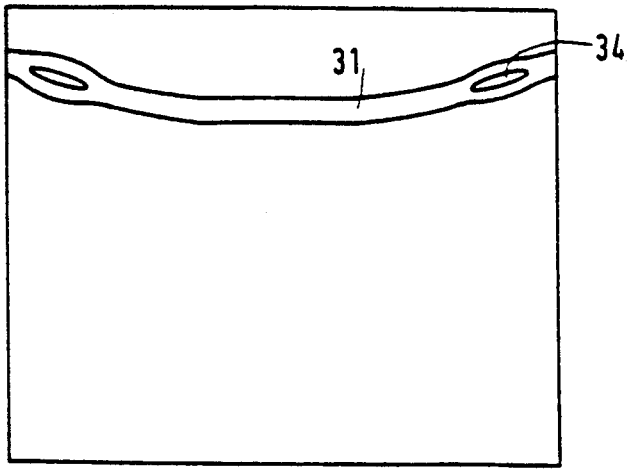
Figure 4:
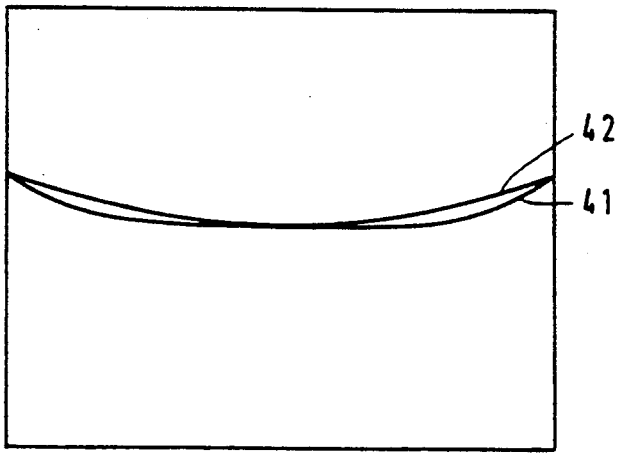
Figure 5:
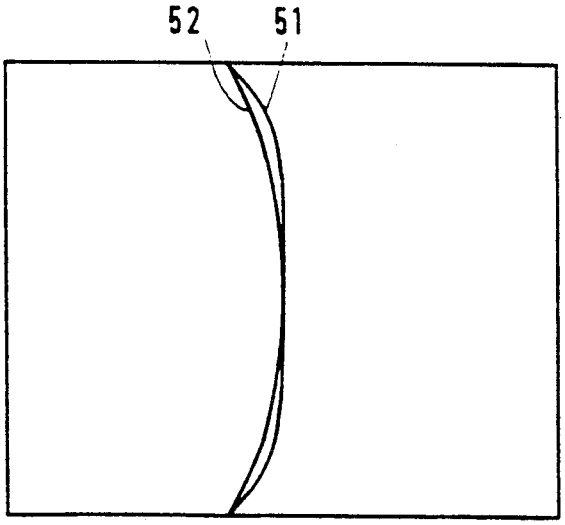

A few embodiments of the cathode ray tube according to the invention will be described in greater detail with reference to the accompanying drawing, in which FIG. 1 is a sectional view of a cathode ray tube according to the invention;

FIG. 2 is a partly perspective elevational view of a display window;

FIGS. 3*a*, 3*b*, 3*c* and 3*d* are front views of a few reflection images on an outside surface of a display window; and FIGS. 4 and 5 show reflection images.

The FIGS. are not drawn to scale. In the FIGS., corresponding parts generally bear the same reference numerals.

DESCRIPTION OF THE INVENTION

A cathode ray tube, in this example color display tube 1, comprises an evacuated envelope 2 which consists of a display window 3, a cone portion 4 and a neck 5. In the neck 5 there is provided an electron gun 6 for generating three electron beams 7, 8 and 9 which extend in one plane, the in-line plane, which in this case is the plane of the drawing. A display screen 10 is situated on the inside of the display window. The display screen 10 comprises a large number of phosphor elements luminescing in red, green and blue. On their way to the display screen 10, the electron beams 7, 8 and 9 are deflected across the display screen 9 by means of deflection unit 11 and pass through a color selection electrode 12 which is arranged in front of the display window 3 and which comprises a thin plate having apertures 13. The color selection electrode is suspended in the display window by means of suspension means 14. The three electron beams 7, 8 and 9 pass through the apertures 13 of the color selection electrode at a small angle with each other and, hence, each electron beam impinges on phosphor elements of only one color.

FIG. 2 is a partly perspective elevational view of a display window. The points of the outside surface can be described by a function $z = f(X,Y)$ where z is the distance between a point and the tangent plane to the center of the outside surface. In general, z is termed the sagittal height. The z-axis extends perpendicularly to the tangent plane to the center of the outside surface of the display window and is indicated in the FIG.. The short axis is indicated as the y-axis, the long axis is indicated as the x-axis. These axes extend perpendicularly to each other and to the z-axis. The outside surface is constructed such that it is mirror symmetrical relative to the short and the long axes. The center of the outside surface coincides with the point of intersection of the long and the short axes. The x-coordinate of a point can be found by projecting this point perpendicularly onto the x-axis. In terms of its absolute value, the x-coordinate is equal to the distance along the x-axis between the center of the outside surface and the point of projection on the x-axis. The sign is positive on one side of the short axis and negative on the other side. The y-coordinate of a point can be found by projecting the point perpendicularly onto the y-axis. In terms of its absolute value, the y-coordinate is equal to the distance along the y-axis between the center of the outside surface and the point of projection on the y-axis. The sign is positive on one side of the long axis and negative on the other side. The X-value of a point is equal to the x-coordinate divided by half the length of the long axis, so that the x-value for the edge of the outside surface at the end of the long axis is 1, and $-1$ at the opposite end of the long axis. The Y-value of a point is equal to the y-coordinate divided by half the length of the short axis, so that the Y-value for the edge of the outside surface at the end of the short axis is 1, and $-1$ at the opposite end of the short axis.

FIGS. 3*a* up to and including 3*d* show front views of a few reflection images on the outside surface of the display window. In FIG. 3*a*, the x-axis and the y-axis are indicated as well as the points $X=1$, $Y=0$ (32) and $X=0$, $Y=1$ (33). These points correspond to a point at an edge of the outside surface at the end of the long axis (point 32) and to a point at the end of the short axis, respectively. The points correspond to the edges of the display screen, i.e. if lines are drawn from the points in the z-direction, the lines intersect the edges of the display screen.

According to the invention, the outside surface is characterized in that it conforms to the characterizing part of claim 1.

FIG. 3*a* shows a reflection image 31 of an elongated light source which is arranged parallel to the x-axis, for $z_{xy}/\text{sign}XY<0$ for the outside surface (FIG. 3*a*) and for $z_{xy}$ varying over the outside surface such that also positive values of $z_{xy}$ occur (FIG. 3*b*). A reflection image as shown in FIG. 3*b* gives the disturbing impression that the display window is very convex. The reflection image as shown in FIG. 3*a* does not have this disadvantage. A similar effect occurs with elongated light sources which are arranged parallel to the y-axis. FIG. 3*c* shows a reflection image 31 of an elongated light source which is arranged parallel to the x-axis, for a cathode ray tube the outside surface of which complies with the formula $-\sqrt{(z_{xx}z_{yy})}<z_{xy}/\text{sign}XY$, and FIG. 3*d* shows a reflection image 31 for a situation in which there are points 34 which do not comply with the above formula. The radius of curvature of the outside surface at a point is dependent on the direction along which the radius of curvature is taken. For each point a radius of curvature in the x- or in the y-direction can be defined. Likewise the radius of curvature in any direction in between the x- and y-direction can be defined. For points 34 which do not comply with the above formula the radius of curvature is positive for some directions and negative for other directions. This has as a consequence that double reflection images occur around these points. This too gives the disturbing impression that the display window is very convex around these points and the perception of flatness of the display window is lost. If the above formula applies for all points which do not lie on the x- or y-axis, then for each point the radius of curvature is positive for all directions. No double reflections occur then.

In a further embodiment of the invention the outside surface complies with the formulae:

$$\partial z/\partial Y=A_1, \text{ for } Y=Y_0,\ X=0,$$

$$\partial z/\partial Y=A_2, \text{ for } Y=Y_0,\ X=1 \text{ and}$$

$$\partial z/\partial Y=A_3, \text{ for } Y=Y_0,\ X=0.5$$

where $(A_1-A_3)/(A_1-A_2)<0.1$, and where $Y_0$ may be any value between $-1$ and $+1$. If this requirement is met, there is relatively little distortion in the reflection of a horizontally arranged light source.

FIG. 4 shows the reflection image 41 of a horizontally arranged light source when this condition is fulfilled, and it shows reflection image 42 when this condition is not fulfilled, in this case when $(A_1-A_3)/(A_1-A_2)=0.25$. In the central part of the display window, i.e. the area between $X=0$ and $X=0.5$, the curvature of the reflection image 41 is much smaller than the curvature of the reflection image 42.

In yet another embodiment of the invention it holds that:

$\partial z/\partial X=B_1$, $B_2$ and $B_3$, for $X=X_0$, $Y=0$, $X_{X0}$, $Y=1$ and $X=X_0$, $Y=0.5$, respectively, where $(B_1-B_3)/(B_1-B_2)<0.1$, where $X_O$ may be any value between $-1$ and 1.

When this condition is fulfilled, there is relatively little distortion in the reflection of a vertically arranged light source.

FIG. 5 shows the reflection image 51 of a vertically arranged light source when the above condition is fulfilled, and it shows the reflection image 52 if $(B_1-B_3)/(B_1-B_2)=0.25$.

The above formulary conditions to be satisfied by the shape of the display window will be elaborated below for a number of shapes of display windows. It is noted that $A_1$, $A_2$, $A_3$ and $B_1$, $B_2$, $B_3$ are shortened forms of $\partial z/\partial X$, for $Y=Y_0$, $X=0$ etc.

For a display window whose outside surface can be described by:

$$z=A*X^2+B*Y^2+C*X^2*Y^2$$

where A, B and C are constants and $A>0$, $B>0$ and $C<0$, the conditions of formula 1 $-\sqrt{(z_{xx}z_{yy})}<z_{xy}/\text{sign}XY<0$ are satisfied if it holds that $-\frac{1}{2}\sqrt{(A+C)(B+C)}<C<0$.

For such screens it holds that $(A_1-A_3)/(A_1-A_2)=0.25$, $(B_1-B_3)/(B_1-B_2)=0.25$. Such a screen does not satisfy the other conditions (formulae 2 and 3) $(A_1-A_3)/(A_1-A_2)<0.1$, and $(B_1-B_3)/(B_1-B_2)<0.1$.

For a display window which can be described by:

$$z=A*X^2+B*Y^2+C*X^2*Y^2+D*(X^2-X^4)*(1-Y^2)$$

where $A>0$, $B>0$, $C<0$ and $D<0$, the conditions of "formula 1" are satisfied if $C-D<0$ and $C+D<0$ (or in other words $D/C<1$) and if it holds that $-\frac{1}{2}\sqrt{(A+C)(B+C)}<C+D$. The conditions of "formula 2" are met if: $D/C>0.8$. Further, it holds that $(B_1-B_3)/(B_1-B_2)=0.25$, so that the condition $(B_1-B_3)/(B_1-B_2)<0.1$ ("formula 3") is not satisfied. For a display window which can be described by:

$$z=A*X^2+B*Y^2+C*X^2*Y^2+E(Y^2-Y^4)*(1-X^2)$$

where $A>0$, $B>0$, $C<0$ and $E<0$, the conditions of "formula 1" are satisfied if:

$C-E<0$ and $C.E<0$ (or in other words $E/C<1$) and if it holds that $-\frac{1}{2}\sqrt{(A+C)(B+C)}<C+E$. The conditions of "formula 3" are satisfied if: $E/C>0.8$. Further, it holds that $(A_1-A_3)/(A_1-A_2)=0.25$, so that the condition $(A_1-A_3)/(A_1-A_2)<0.1$ is not satisfied.

It will be obvious that within the scope of the invention many variations are possible. In the examples a description is given of, for example, a color cathode ray tube; however, the invention is not limited thereto, in further examples the cathode ray tube can be, for example, a monochrome cathode ray tube or a black-white cathode ray tube. In the example, the evacuated envelope comprises one neck 5; however, in further examples the cathode ray tube may comprise more than one neck having an electron gun. In the examples, a number of descriptions of surfaces are given. However, the invention is not limited to these examples nor to the manner in which they are described. In the case of more complicated surfaces there is sometimes more than one manner of giving an approximate description of the surface in the form of a formula. In the case of display windows which can be described by a formula $z=f(X,Y)$ and which have a more complicated shape than the display windows described herein, the partial derivatives across the screen can be calculated after which, either analytically or by means of a computer program, it can be calculated which conditions the formula $f(X, Y)$ must satisfy to comply with the above formulae 1, 2 or 3.

Hereinbefore, all partial derivatives are expressed in the standardized units X and Y. Sometimes, z is expressed in x and y ($z=f(x, y)$). In that case, expressed in x and y, the formulae 1, 2 and 3 can be given by: (formula 1)

$$-\sqrt{(z_{xx}z_{yy})}<z_{xy}/\text{signxy}<0$$

where $z_{xx}=\partial^2z/\partial x^2$, $z_{yy}=\partial^2z/\partial y^2$ and $z_{xy}=\partial^2z/(\partial x\partial y)$, $\text{signxy}=+1$ for $x>0$, $y>0$ and for $x<0$, $y<0$ and $\text{signxy}=-1$ for $x>0$, $y<0$ and for $x<0$, $y>0$; (formula 2)

$$\partial z/\partial y=A_1,\ A_2 \text{ and } A_3 \text{ for } x=0,\ x_O \text{ and } 0.5*x_0,$$

respectively, where $(A_1-A_3)/(A_1-A_2)<0.1$, and $X_o$ is the value of x at the end of the long axis; and (formula 3)

$$\partial z/\partial x=B_1,\ B_2 \text{ and } B_3 \text{ for } y=0,\ y_0 \text{ and } 0.5*y_0,$$

respectively, where $(B_1B_3)/(B\ )<0.1$, and $y_o$ is the value of y at the end of the short axis.

In general, the most clearly visible and, hence, most disturbing reflections occur at the outside surface of the display screen. Reflections may also occur at the inside surface of the display window. The disturbing effects of the latter reflections are reduced if the inside surface of the display window complies with the above formulae 1, 2 and/or 3, where z, X and Y relate to points on the inside surface. In embodiments, both the inside surface and the outside surface may comply with the formulae. Preferably, embodiments of cathode ray tubes according to the invention, the cathode ray tubes comprising a shadow mask, are characterized in that the maximum values of $(A_1-A_3)/(A_1-A_2)$ and/or $(B_1-B_3)/(B_1-B_2)$ for the inside surface are smaller than 0.20 and greater than 0.1. Doming occurs in cathode ray tubes comprising a shadow mask. Doming is a phenomenon which causes picture quality to be adversely affected as a result of bulging of the shadow mask. It is very difficult to attain an acceptable degree of doming when the maximum values of $(A_1-A_3)/(A_1-A_2)$ and/or $(B_1-B_3)/(B_1-B_2)$ are smaller than 0.1. At maximum values in excess of 0.20, the positive effect on reflections is small. The invention is especially important for cathode ray tubes having a relatively small curvature, i.e. having an average radius of curvature larger than e.g. 1500 mm. For such tubes the mentioned negative influences of the disturbing reflections are especially noticeable. Cathode ray tubes of the invention can have an aspect ratio of 3:4, or smaller than 3:4 e.g. smaller than 3:5, e.g. 9:6.

We claim:

1. A cathode ray tube comprising a display window having a curved substantially rectangular outside surface with a long axis and a short axis, characterized in that the outside surface of the display window is given by:

$$z=f(X, Y)$$

where X is the x-coordinate divided by half the length of the long axis, Y is the y-coordinate divided by half the length of the short axis, and each point which is situated off the long axis and short axis complies with the formula $$-\sqrt{(z_{xx}z_{yy})}<z_{xy}/\text{sign}XY<0$$

where $z_{xx}=\partial^2z/\partial X^2$, $z_{yy}=\partial^2z/\partial Y^2$ and $z_{xy}=\partial^2z/(\partial X\partial Y)$, $\text{signXY}=+1$ for $X>0$, $Y>0$ and for $X<0$, $Y<0$ and $\text{signXY}=-1$ for $X>0$, $Y<0$ and for $X<0$, $Y>0$.

2. A cathode ray tube as claimed in claim 1, characterized in that for each line having a constant Y-value it holds that:

$$\partial z/\partial Y=A_1,\ A_2 \text{ and } A_3 \text{ for } X=0,1 \text{ and } 0.5,$$

respectively, where $(A_1-A_3)/(A_1-A_2)<0.1$.

3. A cathode ray tube as claimed in claim 2, characterized in that for each line having a constant X-value it holds that:

$$\partial z/\partial X=B_1,\ B_2 \text{ and } B_3 \text{ for } Y=0,1 \text{ and } 0.5,$$

respectively, where $(B_1-B_3)/(B_1-B_2)<0.1$.

4. A cathode ray tube comprising a display window having a curved substantially rectangular inside surface with a long axis and a short axis, characterized in that the inside surface of the display window is given by:

$$z=f(X, Y)$$

where X is the x-coordinate divided by half the length of the long axis, Y is the y-coordinate divided by half the length of the short axis, and each point which is situated off the long axis and short axis complies with the formula $$-\sqrt{(z_{xx}z_{yy})}<z_{xy}/\mathrm{sign}XY<0$$

where $z_{xx}\partial^2z/\partial X^2$, $z_{yy}=\partial 2z/\partial Y^2$ and $z_{xy}=\partial^2z/(\partial X\partial Y)$, $\mathrm{sign}XY=+1$ for $X>0$, $Y>0$ and for $X<0$, $Y<0$ and $\mathrm{sign}XY=-1$ for $X>0$, $Y<0$ and for $X<0$, $Y>0$.

5. A cathode ray tube as claimed in claim 4, characterized in that for each line having a constant Y-value it holds that: $\partial z/\partial Y=A_1$, $A_2$ and $A_3$ for $X=0$, 1 and 0.5, respectively, where $(A_1-A_3)/(A_1-A_2)<0.1$.

6. A cathode ray tube as claimed in claim 5, characterized in that for each line having a constant X-value it holds that: $\partial z/\partial X=B_1$, $B_2$ and $B_3$ for $Y=0$, 1 and 0.5, respectively, where $(B_1-B_3)/(B_1-B_2)<0.1$.

7. A cathode ray tube as claimed in claim 4, said cathode ray tube comprising a shadow mask, characterized in that for each line having a constant Y-value it holds that:

$\partial z/\partial Y=A_1$, $A_2$ and $A_3$ for $X=0$, 1 and 0.5, respectively, where the maximum value of $(A_1-A_3)/(A_1-A_2)$ ranges between 0.1 and 0.2.

8. A cathode ray tube as claimed in claim 7, said cathode ray tube comprising a shadow mask, characterized in that for each line having a constant X-value it holds that: $\partial z/\partial X=B_1$, $B_2$ and $B_3$ for $Y=0$, 1 and 0.5, respectively, where the maximum value of $(B_1-B_3)/(B_1-B_2)$ ranges between 0.1 and 0.2.

9. A cathode ray tube as claimed in claim 1, characterized in that for each line having a constant X-value it holds that: $\partial z/\partial X=B_1$, $B_2$ and $B_3$ for $Y=0$, 1 and 0.5 respectively, where $(B_1-B_3)/(B_1-B_2)<0.1$.

10. A cathode ray tube as claimed in claim 4, characterized in that for each line having a constant X-value it holds that:

$\partial z/\partial X=B_1$, $B_2$ and $B_3$ for $Y=0$, 1 and 0.5, respectively, where $(B_1-B_3)/(B_1-B_2)<0.1$.

11. A cathode ray tube as claimed in claim 4, said cathode ray tube comprising a shadow mask, characterized in that for each line having a constant X-value it holds that:

$\partial z/\partial X=B_1$, $B_2$ and $B_3$ for $Y=0$, 1 and 0.5, respectively, where the maximum value of $(B_1-B_3)/(B_1-B_2)$ ranges between 0.1 and 0.2.

* * * * *